US011851237B2

(12) United States Patent
Bratsch

(10) Patent No.: US 11,851,237 B2
(45) Date of Patent: Dec. 26, 2023

(54) RECLOSABLE CAN LID

(71) Applicant: XOLUTION GmbH, Munich (DE)

(72) Inventor: Christian Bratsch, Salzburg (AT)

(73) Assignee: XOLUTION TECHNOLOGY GMBH, Munich (DE)

( * ) Notice: Subject to any disclaimer, the term of this patent is extended or adjusted under 35 U.S.C. 154(b) by 369 days.

(21) Appl. No.: 17/257,643

(22) PCT Filed: Jun. 27, 2019

(86) PCT No.: PCT/EP2019/067214
§ 371 (c)(1),
(2) Date: Jan. 4, 2021

(87) PCT Pub. No.: WO2020/007713
PCT Pub. Date: Jan. 9, 2020

(65) Prior Publication Data

US 2021/0300623 A1 Sep. 30, 2021

(30) Foreign Application Priority Data

Jul. 4, 2018 (EP) ..... 18181702

(51) Int. Cl.
*B65D 17/28* (2006.01)

(52) U.S. Cl.
CPC .. *B65D 17/4014* (2018.01); *B65D 2517/0011* (2013.01); *B65D 2517/0034* (2013.01); *B65D 2517/0044* (2013.01)

(58) Field of Classification Search
CPC .... B65D 2517/2028; B65D 2517/0001; B65D 2517/0002; B65D 2517/0004;
(Continued)

(56) References Cited

U.S. PATENT DOCUMENTS 4,463,866 A 8/1984 Mandel
4,605,141 A 8/1986 Won
(Continued)

FOREIGN PATENT DOCUMENTS

CN 101244771 A 8/2008
CN 104290990 A 1/2015
(Continued)

OTHER PUBLICATIONS

Intellectual Property China. Examination Report issued in counterpart application CN 201980044339.2, dated Mar. 4, 2022.
(Continued)

*Primary Examiner* — Kareen K Thomas
(74) *Attorney, Agent, or Firm* — Dykema Gossett PLLC

(57) ABSTRACT

Aspects of the present disclosure are directed to a lid for a container. In one embodiment, the lid of the container includes a lid panel having a break-open region at least partially surrounded by a predetermined breaking line, and having a fastening element arranged on the lid panel. The lid further including a lever tab rotatably attached to the fastening element for breaking open the break-open region along the predetermined breaking line in the direction of an underside of the lid panel and thereby providing a removal opening in the lid panel. In some embodiments, the lever tab includes a closure element for tightly closing the removal opening, the closure element has a first portion mountable on an upper side of the lid panel and partially sealingly enclosing the removal opening and a second portion mountable on a lower surface of the lid panel and partially sealingly enclosing the removal opening.

18 Claims, 4 Drawing Sheets

Figure 1A:
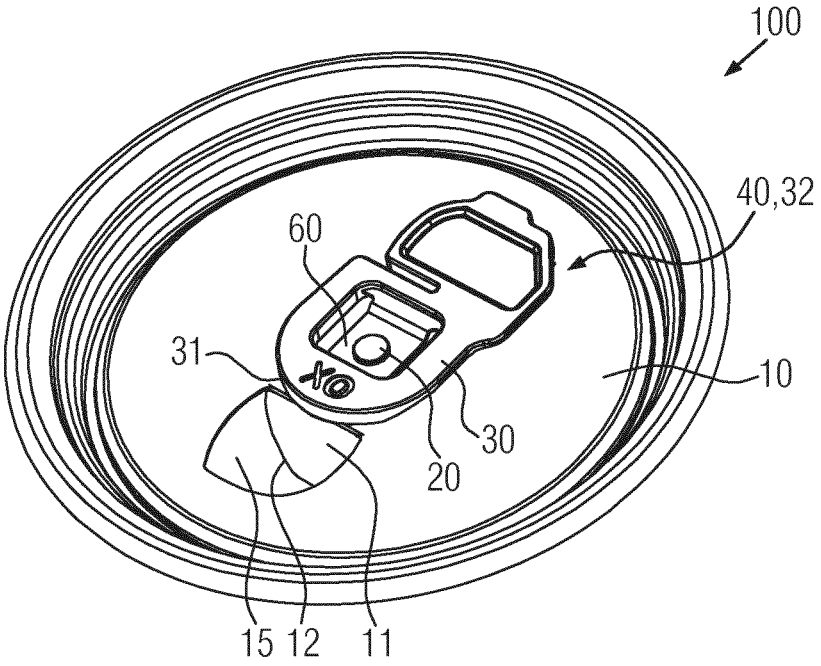
Figure 1B:
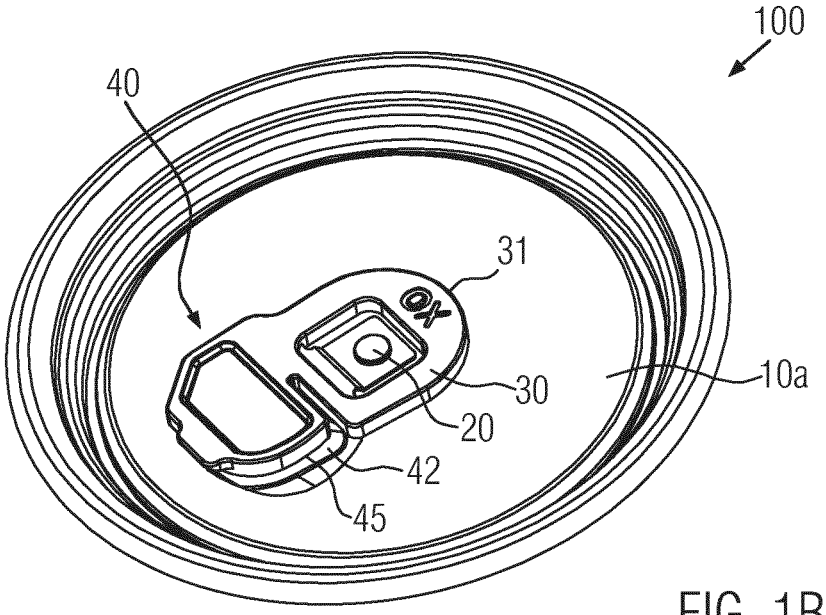
Figure 1C:
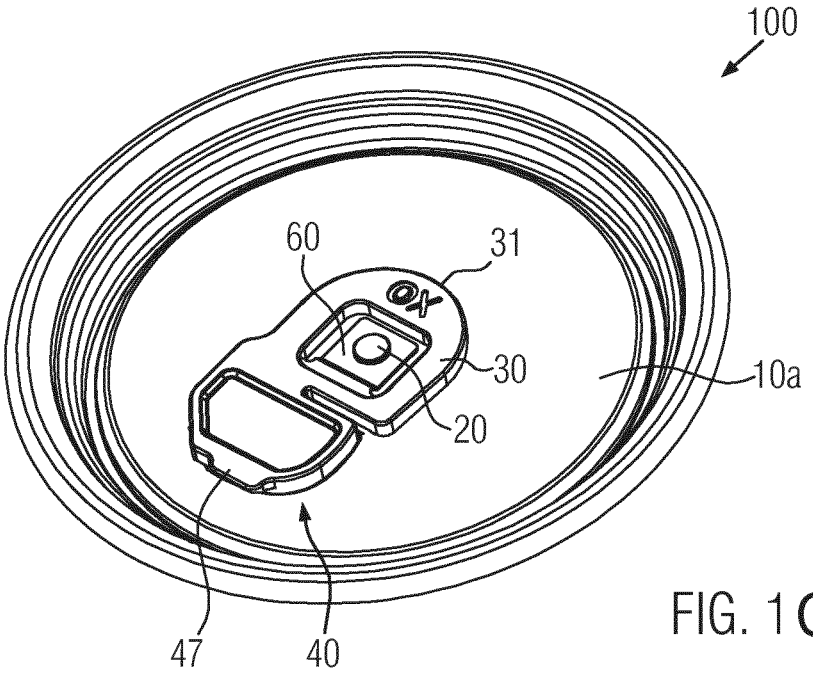
Figure 1D:
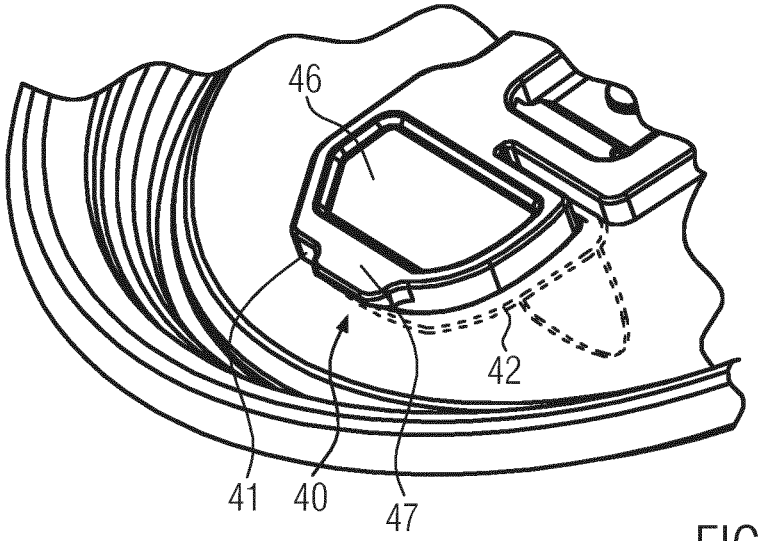
Figure 1E:
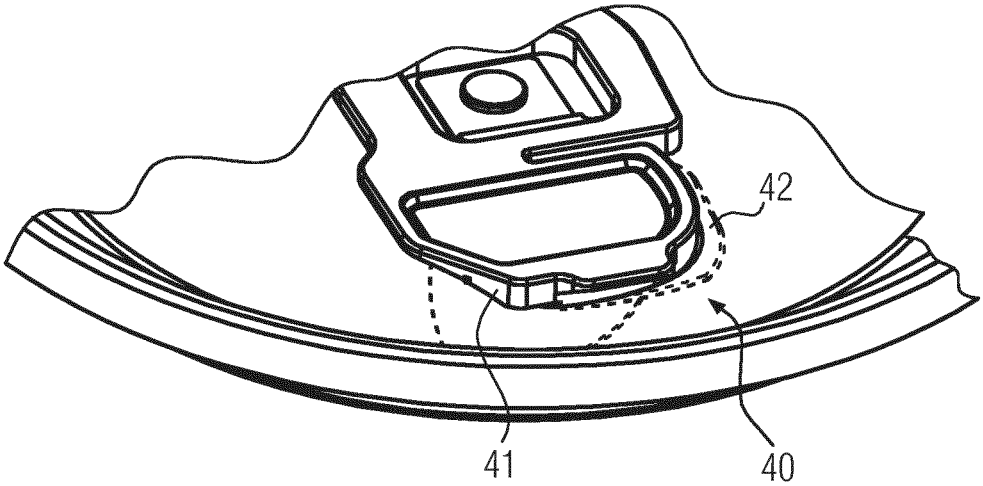

(58) Field of Classification Search
CPC .... B65D 2517/0005; B65D 2517/0007; B65D 2517/0008; B65D 77/10–2028; B65D 2577/10–2041; B65D 17/4014; B65D 2517/0011; B65D 2517/0034; B65D 2517/0044
See application file for complete search history.

(56) References Cited

U.S. PATENT DOCUMENTS

| | | | | |
|---|---|---|---|---|
| 4,681,238 | A | 7/1987 | Sanchez | |
| 5,285,924 | A * | 2/1994 | Morris | B65D 17/4014 220/729 |
| 5,785,199 | A * | 7/1998 | Woidtke | B65D 51/007 220/730 |
| 8,622,238 | B1 * | 1/2014 | Kaper | B65D 17/4014 220/254.4 |
| 9,517,866 | B2 * | 12/2016 | Coffey | B65D 51/1688 |
| 2003/0000952 | A1 * | 1/2003 | Dyren | B65D 17/4014 220/269 |
| 2003/0080130 | A1 * | 5/2003 | Goetz | B65D 17/401 222/548 |
| 2003/0102313 | A1 * | 6/2003 | Weber | B65D 51/007 220/258.2 |
| 2004/0129704 | A1 * | 7/2004 | Battmer | B65D 17/4012 220/269 |
| 2007/0138178 | A1 * | 6/2007 | Erickson | B65D 17/4014 220/269 |
| 2009/0026201 | A1 * | 1/2009 | Hall | B65D 17/4014 220/811 |
| 2010/0282749 | A1 * | 11/2010 | Forrester | B65D 17/4014 220/262 |
| 2011/0232423 | A1 * | 9/2011 | Raymond | B65D 51/007 81/3.55 |
| 2012/0012586 | A1 * | 1/2012 | Rinderer | B65D 17/4014 220/269 |
| 2012/0199586 | A1 * | 8/2012 | Shamalta | B65D 17/4012 220/269 |
| 2013/0295239 | A1 * | 11/2013 | Bernhard | B65D 81/00 426/106 |
| 2014/0332548 | A1 | 11/2014 | Bratsch et al. | |
| 2015/0197366 | A1 * | 7/2015 | Chapin | B65D 85/72 220/254.1 |
| 2015/0375910 | A1 * | 12/2015 | Cohen Bissu | B65D 17/4014 53/484 |
| 2016/0023802 | A1 | 1/2016 | Brandtner | |
| 2017/0050755 | A1 * | 2/2017 | Polushkin | B65D 45/32 |

FOREIGN PATENT DOCUMENTS

| | | | |
|---|---|---|---|
| DE | 29615277 | U1 | 1/1997 |
| DE | 29721300 | U1 | 2/1998 |
| EP | 2409925 | A1 | 1/2012 |
| GB | 2305657 | A | 4/1997 |
| JP | 3027910 | U | 8/1996 |
| WO | 2005051783 | A1 | 6/2005 |
| WO | 2007019592 | A1 | 2/2007 |

OTHER PUBLICATIONS

Intellectual Property Japan. Examination Report issued in counterpart application No. 2020-570755, dated Apr. 7, 2022.
IP Australia; Examination Report No. 1 issued in patent family application 2019296993, dated Dec. 21, 2021.
Intellectual Property India. Examination Report issued in counterpart application 202117000826, dated Jul. 30, 2021.

* cited by examiner

RECLOSABLE CAN LID

CROSS-REFERENCE TO RELATED APPLICATIONS

This application is a national stage filing based upon International PCT Application No. PCT/EP2019/067214, filed 27 Jun. 2019, which claims the benefit of priority to European application No. 18181702.4, filed 4 Jul. 2018.

FIELD OF INVENTION

The invention refers to a lid for a container, in particular for a beverage can, comprising: a lid panel having a break-open region at least partially surrounded by a predetermined breaking line, and having a fastening element arranged on the lid panel; and a lever tab rotatably attached to the fastening element for breaking open the break-open region along the predetermined breaking line in the direction of an underside of the lid panel and thereby providing a removal opening in the lid panel.

STATE OF THE ART

Lids of the type mentioned above are known from the state of the art and are used, for example, for beverage cans. The can is completely closed by the lid made of sheet material (aluminum) before it is opened for the first time. For opening, the lever tab is lifted by the user on one side, whereby the opposite side of the lever tab presses on the break-open region, which breaks open along the existing predetermined breaking line (usually provided as an indentation in the lid material) and is pressed into the can interior. This provides a removal opening (pouring opening, drinking opening). A disadvantage is that the removal opening cannot be re-closed after the can has been opened for the first time.

DESCRIPTION OF THE INVENTION

It is the object of the invention to overcome the mentioned disadvantage.

This object is solved by a lid for a container according to claim 1.

The lid for a container, in particular for a can, according to the invention comprises: a lid panel having a break-open region at least partially surrounded by a predetermined breaking line, and having a fastening element arranged on the lid panel; a lever tab rotatably attached to the fastening element for breaking open the break-open region along the predetermined breaking line in the direction of an underside of the lid panel and thus providing a removal opening in the lid panel; wherein the lever tab comprises a closure element for tightly closing the removal opening; wherein the closure element has a first portion mountable on an upper side of the lid panel and partially sealingly enclosing the removal opening; and wherein the closure element has a second portion mountable on a lower surface of the lid panel and partially sealingly enclosing the removal opening.

According to the invention, after the container has been opened for the first time, the lever tab is rotated around the fastening element and the second portion of the closure element is guided into the removal opening, so that it partially covers the removal opening from the underside of the lid panel and partially encloses it in a sealing manner, and the first portion of the closure element is arranged resting on the lid panel, partially enclosing the removal opening in a sealing manner, as a result of which closure (or re-closure) of the removal opening takes place. Re-opening can be effected by rotating the lever tab in the opposite direction, whereby the second portion is pulled out again.

The lid according to the invention can be further formed in that a break-up element for breaking-up the break-up region is arranged at a first end portion of the lever tab, and the closure element is arranged at a second end portion of the lever tab. Thereby, the first end portion and the second end portion may be provided opposite to each other with respect to the fastening element. Thus, the break-up element and the sealing closure element are spaced apart from each other and any deformation of the break-up element when the container is opened for the first time does not affect the closure element and its sealing action.

The lever tab may comprise a sheet material, in particular a sheet material containing aluminum, and a plastic material. The sheet material may be used, for example, for attachment to the fastening element. The break-up element may be formed of the sheet material to provide good strength for the break-up operation. Alternatively, the break-up element may be formed of the plastic material, preferably having a pressing portion protruding toward the underside with which the break-up region is locally contacted during the break-up operation to apply pressure thereto. The closure element can be made of the plastic material. In the manufacturing process, a sheet metal flap can be at least partially enclosed by the plastic material by means of injection molding.

In another embodiment, the second portion of the closure element is further provided for locking the closure element when the removal opening is closed by the closure element. By inserting the second portion on the underside of the lid panel, an unintentional opening of the closure element is prevented, for example by an internal pressure of the container.

According to another embodiment, the lever tab may comprise a fastening tongue for fastening the lever tab to the fastening element. In connection with the sheet material of the lever tab, the fastening tongue may be formed from the sheet material.

In another embodiment, the removal opening can be re-closed or re-opened by rotating the lever tab about the fastening element. In this manner, by rotation about the fastening element, the closure element can be positioned to cover the removal opening with the second portion guided into the removal opening to abut from the underside of the lid panel partially around the removal opening, and with the first portion abutting from the upper side of the lid panel partially around the removal opening so that the first and second portions together completely close the removal opening.

Thus, according to another embodiment, when the lever tab is rotated to close the removal opening, the second portion of the closure element can be guided through the removal opening to the underside of the lid panel.

In this case, the closure element can have an abutment which interacts with an edge region of the lid panel at the removal opening when the removal opening is closed, thereby limiting the rotation of the lever tab during closure.

Another embodiment is that the closure element has a handle section that can be lifted by a user in order to bring about pressure equalization between an interior space of a container and an exterior space before the closed removal opening is reopened. This makes it possible to achieve a pressure reduction of the interior of the container after an initial opening of the container and a subsequent closing or re-closing of the removal opening with the closure element and before a re-opening of the removal opening, thus preventing, for example, a rapid foaming or spouting of a carbonated beverage.

According to another embodiment, the closure element may have a lowered portion to provide engagement by a user. This allows the lever tab to be easily grasped and rotated.

In another embodiment, the material of the first and second portions of the closure element is sufficiently flexible to sealingly close the removal opening, wherein in connection with a plastic material of the closure element, the plastic material is sufficiently flexible. Thus, the removal opening can be tightly closed without the need for further sealing material.

According to another embodiment, the first portion of the closure element that abuts at the upper side of the lid panel when the removal opening is closed and the second portion of the closure element that abuts at the underside of the lid panel when the removal opening is closed can define first and second transition points from the upper side to the underside; wherein the first and second transition points define a line across the removal opening, and wherein preferably an area of the second portion is greater than an area of the first portion. The line divides the closure element into first and second sections. In this way it is ensured when an internal pressure occurs, for example in the case of a carbonated beverage, that the pressure on the second section of the closure element having the second portion is greater than the pressure on a first section of the closure element having the first portion, so that pressing open of the closure element by partial rotation about the line as axis of rotation is prevented.

Another further development is that the first portion comprises a locking element for locking the closure element when the removal opening is closed by the closure element, in particular wherein the locking element is provided displaceably or rotatably and the locking element comprises an actuating part for actuation by a user and a latch part coupled to the actuating part for locking the closure element by mechanical interaction of the latch part with the underside of the lid panel. The locking element can be formed by an injection molding process (assembly injection molding) in a form-fitting manner with the closure element (and yet movable in the closure element, in particular rotatable therein).

The locking element may be provided slidable or rotatable, and the locking element may include an actuating part for actuation by a user and a latch part coupled to the actuating part for locking the closure element by mechanical interaction of the latch part with the underside of the lid panel.

The locking element can be rotated about an axis at least partially parallel to the lid panel, whereby the latch part can be folded into mechanical contact with the underside of the lid panel or can be folded away to release the mechanical contact; or the locking element can be rotated about an axis at least partially perpendicular to the lid panel, whereby the latch part can be rotated into mechanical contact with the underside of the lid panel or can be rotated away to release the mechanical contact.

Furthermore, the actuating part of the locking element can be arranged on an upper side of the closure element and the latch part can be arranged on an underside of the closure element. The actuating part of the locking element is then easily accessible to a user from the top side.

According to another embodiment, the locking element may comprise a ventilation opening.

In this case, the ventilation opening can be closed during a locking process that can be performed with the locking element and can be released during an unlocking process that can be performed with the locking element. In this way, pressure equalization between the interior and the exterior of the container can take place during the unlocking process.

The ventilation opening can be provided in the latch part of the locking element. In particular, the mechanical contact between the latch part and the underside of the lid panel (inside of the lid panel of the container) can thus provide a sealing closure of the ventilation opening in the locked state of the closure element.

In another embodiment, the closure element comprises a resilient seal for at least partially sealing the removal opening, in particular wherein the seal extends only partially around the removal opening when the removal opening is closed.

The resilient seal can be applied (arranged at the first area) at the upper side of the lid panel partially sealingly enclosing the removal opening and/or (arranged at the second area) at the underside of the lid panel partially sealingly enclosing the removal opening. In connection with the plastic material, the seal may be arranged on or partially in the plastic material. The sealing effect is improved by a resilient seal. This seal can be arranged in a simple manner on or in the plastic material, for example by gluing, welding or inserting/pressing it onto the underside of the closure element and/or a recess provided for this purpose.

In another embodiment, a seal enclosing the fastening element is provided on the underside of the fastening element. In conjunction with a plastic material of the lever tab, the seal may be provided on the plastic material of the lever tab and/or formed integrally with the plastic material of the lever tab. The seal may be provided on and/or integrally formed with the plastic material of the lever tab. This seal is used to keep contamination away from the underside of the lever tab in the area of the fastening element (e.g. in the form of a rivet).

The invention further provides a container, in particular a can, wherein the container comprises a base body and a lid according to the invention or a lid according to one of the further embodiments.

The aforementioned further developments can be used individually or suitably combined with each other as claimed.

Further features and exemplary embodiments as well as advantages of the present invention are explained in more detail below with reference to the drawings. It is understood that the embodiments do not exhaust the scope of the present invention. It is further understood that some or all of the features described below may also be combined in other ways.

DRAWINGS

FIG. 1 shows a first embodiment of a lid according to the invention.

EMBODIMENTS

In the drawings, identical reference numerals denote identical or comparable elements.

FIG. 1 A, B, C, D, E, F schematically illustrates a first embodiment of a lid 100 for a beverage can according to the invention.

In this first embodiment, the lid 100 according to the invention comprises a lid panel 10 made of an aluminum sheet with a break-open region 11. The break-open region 11 is partially surrounded by a predetermined breaking line 12. Furthermore, a fastening element 20 (rivet 20) is arranged on the lid panel 10 and a lever tab 30 rotatably attached to the fastening element 20 for breaking open the break-open region 11 along the predetermined breaking line 12 in the direction of a underside 10*b* of the lid panel 10, thereby providing a removal opening 15 in the lid panel 10. The lever tab includes a closure element 40 for sealingly closing the removal opening, the closure element 40 having a first portion 41 mountable on an upper side 10*a* of the lid panel 10 and partially sealingly enclosing the removal opening 15; and the closure element 40 having a second portion 42 mountable on a lower surface of the lid panel 10 and partially sealingly enclosing the removal opening 15.

A break-up element 31 for breaking up the break-up region 11 is arranged at a first end portion of the lever tab 30, and the locking element 40 is disposed at a second end portion 32 of the lever tab 30. The first end portion 31 and the second end portion 32 are provided opposite to each other with respect to the fastening element 20.

After the container has been opened for the first time, the lever tab 30 is rotated around the fastening element 20 and the second portion 42 of the closure element 40 is guided into the removal opening 15 so that it partially covers and partially sealingly encloses the removal opening 15 from the underside of the lid panel 10 and the first portion 41 of the closure element 40 is arranged resting on the lid panel 10 partially sealingly enclosing the removal opening 15, whereby a closure (or re-closure) of the removal opening 15 takes place. Re-opening may be effected by rotating the lever tab 30 in the opposite direction, whereby the second portion 42 of the closure element 40 is again pulled out of the removal opening 15.

The lever tab 30 includes a sheet material, such as a sheet material including aluminum, and a plastic material. The sheet material is used to attach the lever tab 30 to the fastening element 20, and the lever tab includes a fastening tongue 60 for fastening the lever tab 30 to the fastening element 20. The fastening tongue 60 is formed of the sheet material. The break-up element 31 is formed of the plastic material, wherein a pressing portion protruding toward the underside exerts pressure on and breaks open the break-up region 11 during the break-up operation. The closure element 40 is also made of the plastic material. In the manufacturing process, a sheet metal flap is at least partially enclosed by the plastic material by means of injection molding.

The closure element 40 includes an abutment 45 that interacts with an edge portion of the lid panel 10 at the removal opening 15 during closure of the removal opening 15, thereby limiting rotation of the lever tab 30 during closure.

Furthermore, the closure element 40 comprises a handle portion 47 that can be lifted by a user to effect pressure equalization between an interior space of a container and an exterior space before reopening the closed removal opening 15. Thus, it is possible to achieve a pressure reduction of the interior of the container after an initial opening of the container and a subsequent closing or re-closing of the removal opening 15 with the closure element 40 and before a reopening of the removal opening 15 in order to thus prevent, for example, a rapid foaming or spouting of a carbonated beverage.

The locking element 40 may include a lowered portion 46 to provide engagement by a user. This allows the lever tab 30 to be easily grasped and rotated.

The plastic material of the first and second portions 41, 42 of the closure element 40 is sufficiently flexible (or elastic) to sealably close the removal opening 15. Thus, the removal opening 15 can be sealed tightly without the need for further sealing material.

Figure 1F:
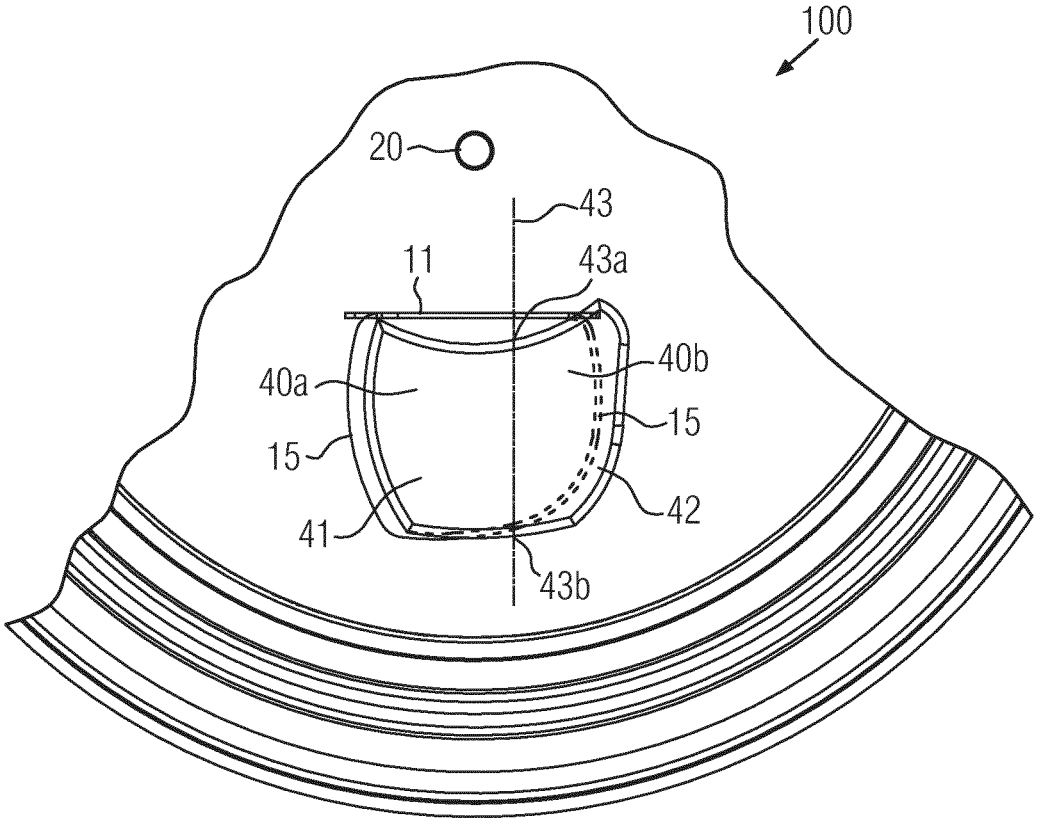

FIG. 1F shows a underside 10 of the lid panel 10, wherein the closure element 40 closes the removal opening 15. A first portion 41 of the closure element, which engages the upper side 10*a* of the lid panel 10 when the removal opening is closed, and a second portion 42 of the closure element, which engages the underside of the lid panel when the removal opening is closed, define first and second transitional portions 43*a*, 43*b* from the upper side 10*a* to the underside 10*b*; wherein the first and second transitional portions 43*a*, 43*b* define a line 43 across the removal opening 15. The line 43 divides the closure element 40 into first and second portions 40*a*, 40*b* that are subjected to pressure from the underside. Preferably, an area of the second portion 40*b* is larger than an area of the first portion 40*a*. In this way, when an internal pressure occurs, for example in the case of a carbonated beverage, it is ensured that the pressure on the second portion 40*b* of the closure element 40 with the second portion 42 is greater than the pressure on the first portion 40*a* of the closure element 40 with the first portion 41, so that a pressing open of the closure element 40 by partial rotation about the line 43 as an axis of rotation is avoided.

The invention claimed is:

1. Lid for a container comprising:

a lid panel having a break-open region which is at least partially surrounded by a predetermined breaking line, and a fastening element which is arranged on the lid panel;

a lever tab rotatably attached to the fastening element and configured and arranged for breaking open the break-open region along the predetermined breaking line in the direction of an underside of the lid panel and thus providing a removal opening in the lid panel;

wherein the lever tab includes a closure element configured and arranged for sealingly closing the removal opening, the closure element includes a first portion being configured to partially abut from an upper side of the lid panel around the removal opening and partially sealingly enclosing the removal opening, when the lever tab is rotated around the fastening element, and a second portion being configured to partially abut from an underside of the lid panel around the removal opening and partially sealingly enclosing the removal opening, when the lever tab is rotated around the fastening element.

2. The lid according to claim 1, further including a break-up element configured and arranged for breaking up the break-open region, the break-up element is arranged at a first end portion of the lever tab and the closure element is arranged at a second end portion of the lever tab.

3. The lid according to claim 1, wherein the lever tab further includes a sheet material containing aluminum, and a plastic material.

4. The lid according to claim 1, wherein the second portion of the closure element is further configured and arranged for locking the closure element when the removal opening is closed by the closure element.

5. The lid according to claim 3, wherein the lever tab includes a fastening tongue configured and arranged for fastening the lever tab to the fastening element.

6. The lid according to claim 1, wherein the removal opening is configured and arranged to be closed again or opened again by rotating the lever tab about the fastening element.

7. The lid according to claim 1, wherein, in response to the lever tab rotating to close the removal opening, the second portion of the closure element is configured and arranged to be guided through the removal opening to the underside of the lid panel.

8. The lid according to claim 7, wherein the closure element has an abutment which interacts with an edge region of the lid panel at the removal opening during closure of the removal opening and thereby limits the rotation of the lever tab during closure.

9. The lid according to claim 1, wherein the closure element includes a handle portion which is configured and arranged to be liftable by a user to effect pressure equalization between an interior space of the container and an exterior space prior to opening the closed removal opening.

10. The lid according to claim 1, wherein the closure element has a lowered portion configured and arranged to provide engagement by a user.

11. The lid according to claim 3, wherein the first and second portions of the closure element are configured and arranged to flex in order to facilitate sealing.

12. The lid according to claim 1, further including first and second transition points from the upper side to the underside are defined by the first portion of the closure element abutting from the upper side of the lid panel when the removal opening is closed, and the second portion of the closure element abutting from the underside of the lid panel when the removal opening is closed;

wherein the first and second transition points define a line across the removal opening.

13. The lid according to claim 1, wherein the first portion of the closure element includes a locking element configured and arranged for locking the closure element when the removal opening is closed by the closure element, in particular wherein the locking element is provided displaceably or rotatably and the locking element includes an actuating part configured and arranged for actuation by a user and a latch part coupled to the actuating part configured and arranged for locking the closure element by mechanical interaction of the latch part with the underside of the lid panel.

14. The lid according to claim 1, wherein the closure element further includes a resilient seal for at least partially sealing the removal opening, in particular wherein the seal extends only partially around the removal opening when the removal opening is closed.

15. The lid according to claim 2, wherein the first end portion and the second end portion are provided opposite to each other with respect to the fastening element.

16. The lid according to claim 5, wherein the fastening tongue is formed from the sheet material.

17. The lid according to claim 12, wherein an area of a second section of the closure element pressurizable from the underside having the second portion is greater than an area of a first section of the closure element pressurizable from the underside having the first portion.

18. Container comprising:

a base body; and a lid including a lid panel having a break-open region which is at least partially surrounded by a predetermined breaking line, and a fastening element which is arranged on the lid panel;

a lever tab rotatably attached to the fastening element configured and arranged for breaking open the break-open region along the predetermined breaking line in the direction of an underside of the lid panel and thus providing a removal opening in the lid panel;

wherein the lever tab includes a closure element configured and arranged for sealingly closing the removal opening, wherein the closure element has a first portion configured and arranged to partially abut from an upper side of the lid panel around the removal opening and partially sealingly enclosing the removal opening, when the lever tab is rotated around the fastening element; and a second portion configured and arranged to partially abut from an underside of the lid panel around the removal opening and partially sealingly enclosing the removal opening, when the lever tab is rotated around the fastening element.

* * * * *